US006695937B1

(12) United States Patent
Stites, III

(10) Patent No.: US 6,695,937 B1
(45) Date of Patent: Feb. 24, 2004

(54) STEEL GOLF CLUB HEAD HAVING REDUCED FACE THICKNESS AND OPTIMUM DISTRIBUTED MASS

(75) Inventor: John Thomas Stites, III, Fort Worth, TX (US)

(73) Assignee: Nicklaus Golf Equipment Co., L.C., West Palm Beach, FL (US)

( * ) Notice: Subject to any disclaimer, the term of this patent is extended or adjusted under 35 U.S.C. 154(b) by 137 days.

(21) Appl. No.: 09/616,599

(22) Filed: Jul. 14, 2000

(51) Int. Cl.[7] ..... C21D 6/04
(52) U.S. Cl. ..... 148/577; 148/578; 473/292
(58) Field of Search ..... 148/577, 578; 473/292

(56) References Cited

U.S. PATENT DOCUMENTS

| | | | | |
|---|---|---|---|---|
| 5,046,733 | A | 9/1991 | Antonious | |
| 5,048,834 | A | 9/1991 | Gorman | |
| 5,184,823 | A | 2/1993 | Desboilles et al. | |
| 5,413,336 | A | 5/1995 | Iwanaga | |
| 5,437,456 | A | 8/1995 | Schmidt et al. | |
| 5,472,203 | A | 12/1995 | Schmidt et al. | |
| 5,524,880 | A | 6/1996 | Kobayashi | |
| 5,549,297 | A | 8/1996 | Mahaffey | |
| 5,658,209 | A | 8/1997 | Blakemore | |
| 5,683,310 | A | 11/1997 | Chen | |
| 5,722,900 | A | 3/1998 | Sung | |
| 5,807,191 | A | 9/1998 | Nakahara | |
| 6,164,079 | A * | 12/2000 | Waldmann et al. | 62/62 |
| 6,248,025 | B1 * | 6/2001 | Murphy et al. | 473/324 |
| 6,364,789 | B1 * | 4/2002 | Kosmatka | 473/329 |

FOREIGN PATENT DOCUMENTS

JP 06269520 * 9/1994

OTHER PUBLICATIONS

"License to Freezer", *Industrial Distribution*, Mar. 1999, Ken Brack http://www.manufactruing.net.

* cited by examiner

*Primary Examiner*—Sikyin Ip
(74) *Attorney, Agent, or Firm*—Fay, Sharpe, Fagan, Minnich & McKee, LLP

(57) ABSTRACT

A golf club head is comprised of cryogenically treated steel resulting in the striking face having a reduced face thickness of between 0.115 inches and 0.130 inches, and therefore, a reduced striking face mass. Extra material which is eliminated from the striking face, is distributed in other areas of the club head to enhance performance. In an iron club head embodiment, the club head includes a heel portion, toe portion, bottom sole portion, top ridge portion, hosel portion, striking face, rear surface, and peripheral mass on the rear surface which forms a rear cavity. A cantilevered mass extends from the bottom sole portion toward the top ridge portion within the rear cavity, spaced apart from the rear surface. In a wood club head embodiment, the club head includes a hollow body having an inner cavity delimited by a sole portion, a striking face, a heel portion, a toe portion, and a crown portion which links the striking face, toe portion, and heel portion. A weight chip of higher density material is located along the sole portion of the head. The iron and wood embodiments enjoy an optimum weight distribution which is below and behind the sweet spot, producing higher trajectory golf shots and more forgiving off-center hits.

5 Claims, 5 Drawing Sheets

STEEL GOLF CLUB HEAD HAVING REDUCED FACE THICKNESS AND OPTIMUM DISTRIBUTED MASS

BACKGROUND OF THE INVENTION

The present invention relates to the art of golf clubs and, more particularly, to iron type and wood type golf club heads weighted for improved performance.

Golf clubs comprise a shaft and a club head and are generally classified into three categories: woods, irons, and putters. Irons are classified by loft angle. Irons with low loft angles, e.g. 20°–30°, are classified as long irons, while irons with large loft angles, e.g. 40°–50°, are classified as short irons. Typically irons are numbered from long to short, i.e. 1, 2, 3, 4, 5, 6, 7, 8, 9, PW (pitching wedge), SW (sand wedge), and LW (lob wedge). Irons include a head joined to a hosel and a shaft with the shaft being attached to the head by fitting the shaft into a bore formed in the hosel. The hosel is typically attached to and formed integrally with the head of an iron. Conventionally, the golf club head includes a heel, a bottom sole, a toe, a planar striking face and a back side.

Golfing irons can be said to be either a traditional design wherein the iron is forged and has a generally continuous back portion on the club blade or of a second type of design known as cavity back. In the cavity back design, the back portion of the club blade includes a substantial depression or cavity which has the effect of providing perimeter weighting for the club head. Traditionally, cavity back clubs which include perimeter weighting have shown to provide a larger "sweet spot" or striking area such that a ball need not be struck precisely in the center of mass of the club to produce an acceptable golf shot.

In designing wood and iron club heads, factors such as weight distribution, overall finish weight, and center of gravity are of importance. In an effort to reduce the overall finish weight of a club, lighter and stronger materials have been used. Conventional wooden club heads have been replaced by stainless steel club heads which have, in turn, been replaced by titanium club heads. Titanium has proven to be a desirable material because of its strength and reduced mass. However, titanium is quite expensive. Therefore, a need exists for a golf club head comprised of a cost-effective, light-weight, and strong material. In addition, an optimized weight distribution which enhances overall performance is desired.

The present invention contemplates new and improved golf club heads which overcome the above-referenced problems and others.

SUMMARY OF THE INVENTION

In accordance with one aspect of the present invention, an iron type golf club head includes a heel portion, toe portion, bottom sole portion, top ridge portion, a hosel portion, a striking face which contains a primary striking zone, and a rear surface. A peripheral mass is formed on the rear surface adjacent the heel, toe, bottom sole, and top ridge portions. The peripheral mass defines a rear cavity where the bottom of the rear cavity is defined by the rear surface. A cantilevered mass extends from the bottom sole portion toward the top ridge portion within the rear cavity. The cantilevered mass is spaced apart from the rear surface.

In accordance with a more limited aspect of the present invention, the primary striking zone of the striking face has a thickness between 0.115 inches and 0.135 inches. Further, the iron type golf club head is comprised of cryogenically treated steel.

In accordance with another aspect of the present invention, a metal wood type golf club head includes a hollow body having an inner cavity delimited by a sole portion, a striking face having a primary striking zone, a heel portion having an opening defining a shaft axis for the introduction of a shaft, a toe portion, and a crown portion linking the striking face, toe portion, and heel portion. A higher density weight chip is located along the sole portion, providing a center of gravity which is substantially closer to the sole portion than the crown portion.

In accordance with a more limited aspect of the present invention, the primary striking zone of the striking face has a thickness between 0.130 inches and 0.135 inches.

In accordance with another aspect of the present invention, an iron set includes a plurality of irons having increasing size numbers. Each iron head of the iron set includes a heel portion, toe portion, bottom sole portion, top ridge portion, a hosel portion, a striking face which contains a primary striking zone, and a rear surface. A peripheral mass is formed on the rear surface adjacent the heel, toe, bottom sole, and top ridge portions. The peripheral mass defines a rear cavity where the bottom of the rear cavity is defined by the rear surface. A cantilevered mass extends from the bottom sole portion toward the top ridge portion within the rear cavity. The cantilevered mass is spaced apart from the rear surface.

In accordance with a more limited aspect of the present invention, the primary striking zone of each striking face has a thickness between 0.115 inches and 0.135 inches. Further, the iron heads are comprised of cryogenically treated steel.

In accordance with another aspect of the present invention, a method of making a golf club head includes forming the club head having a primary striking zone, a top portion, a bottom portion, a toe portion, and a heel portion, wherein at least the striking face of the club head is cryogenically treated steel. The primary striking zone has at least a portion having a thickness between 0.115 inches and 0.135 inches, where the face thickness results in a reduced striking zone mass. The method further includes distributing mass not used in the reduced striking zone mass about at least one of the striking face, the top portion, the bottom portion, the toe portion, the heel portion.

In accordance with another aspect of the present invention, a method of constructing a golf club head includes assembling the golf club head including a striking face, a top portion, a bottom portion, a toe portion, and a heel portion, and cryogenically treating the assembled golf club head. Alternatively, the method includes cryogenically treating a striking face and assembling the striking face in contact with a top portion, a bottom portion, a toe portion, and a heel portion.

One advantage of the present invention is that it has a reduced face thickness.

Another advantage of the present invention is that it provides optimized weight distribution.

Another advantage of the present invention is that it provides a lower center of gravity.

Another advantage of the present invention is that it provides greater distance and accuracy for off-center hits.

Another advantage of the present invention is that it provides enhanced energy transfer.

Yet another advantage of the present invention resides in the welding of a tungsten weight clip in the sole portion of the wood type club.

Still another advantage of the present invention resides in variable positioning of the cantilevered mass depending on the iron size number.

Other benefits and advantages of the present invention will become apparent to those skilled in the art upon a reading and understanding of the preferred embodiments.

Brief Description of the Drawings

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
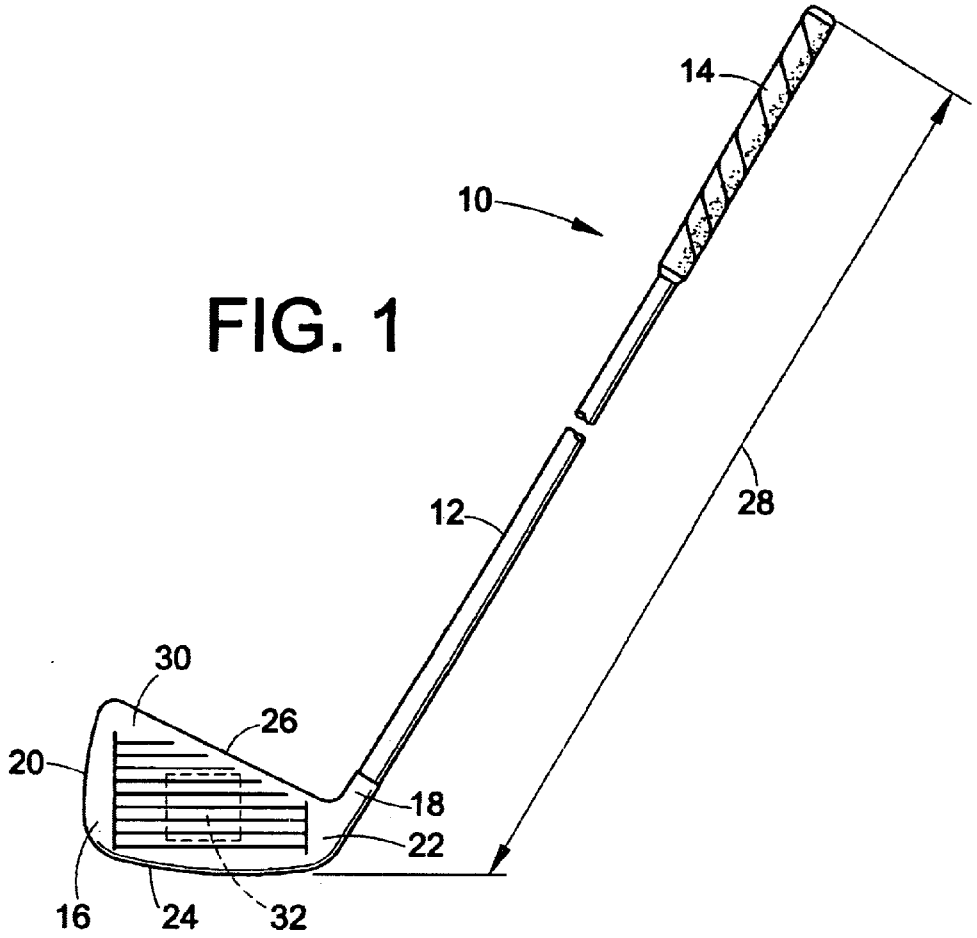
FIG. 1 is a front view of an iron in accordance with the present invention.

With reference to FIG. 1, an iron 10 comprises a shaft 12 with a grip 14 and a head 16. The head 16 is connected by a hosel 18 to the shaft 12 in a conventional manner. Similarly, the grip 14 is attached to the shaft 12 in a conventional manner. The head 16 comprises a toe portion 20, heel portion 22, sole portion 24 and top ridge portion 26. The finished club height 28 progressively decreases from long irons, e.g. 2, 3, 4, to short irons, e.g. 8, 9, PW. The front striking face 30, which contains a primary striking zone or sweet spot 32, is suitably scored with grooves.

Figure 2:
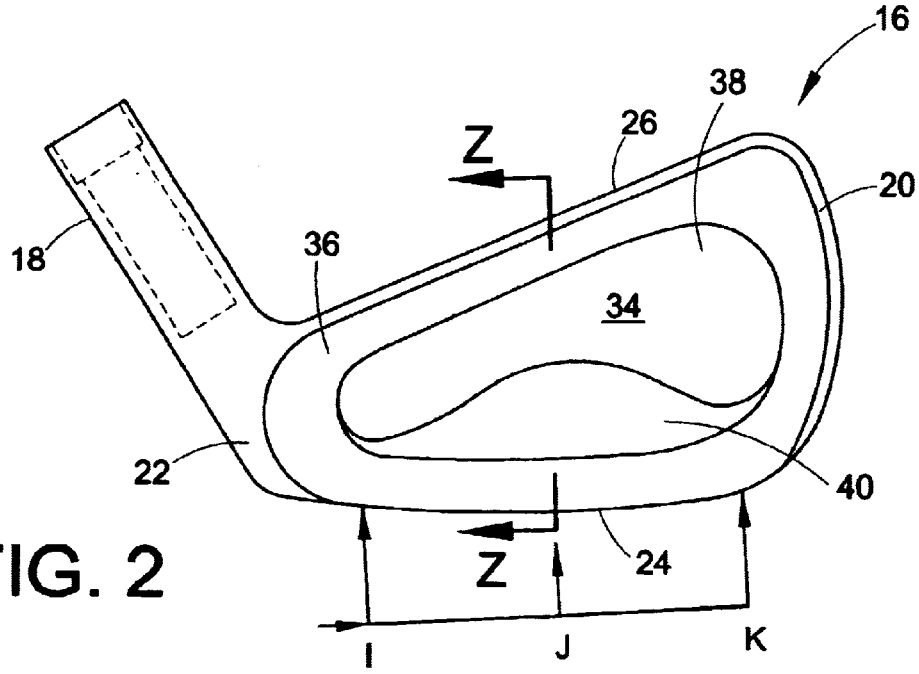
FIG. 2 is a back view of an iron club head in accordance with the present invention.

FIG. 2 illustrates a back view of the iron club head 16. A peripheral mass 36 is formed on the rear surface 34 of the club head 16, defining a rear cavity 38. Artisans will appreciate that cavity back or perimeter weighted clubs enjoy a larger sweet spot or hitting area than conventional forged irons. As shown in FIG. 2, a cantilevered mass 40 extends from the bottom sole portion 24 toward the top ridge portion 26 within the rear cavity 38. As will be described more fully below, the cantilevered mass 40 is variably positioned along the bottom sole portion 24 below and behind a primary striking zone or sweet spot 32 of the striking face 30. The location of the cantilevered mass 40 below and behind the sweet spot lowers the center of gravity of the club which aids the golfer in placing the center of gravity of the club head below the center of gravity of the golf ball at the moment of impact, producing a properly airborne and solidly hit ball having a high trajectory.

Figure 3:
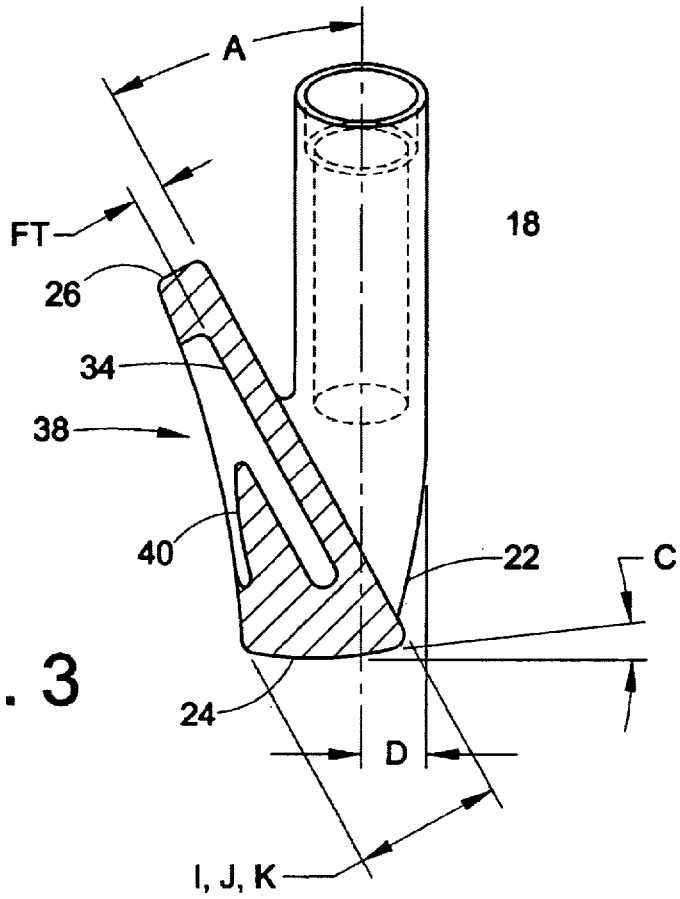
FIG. 3 is a side cross-sectional view along line z—z of the iron club head of FIG. 2.
Figure 4:
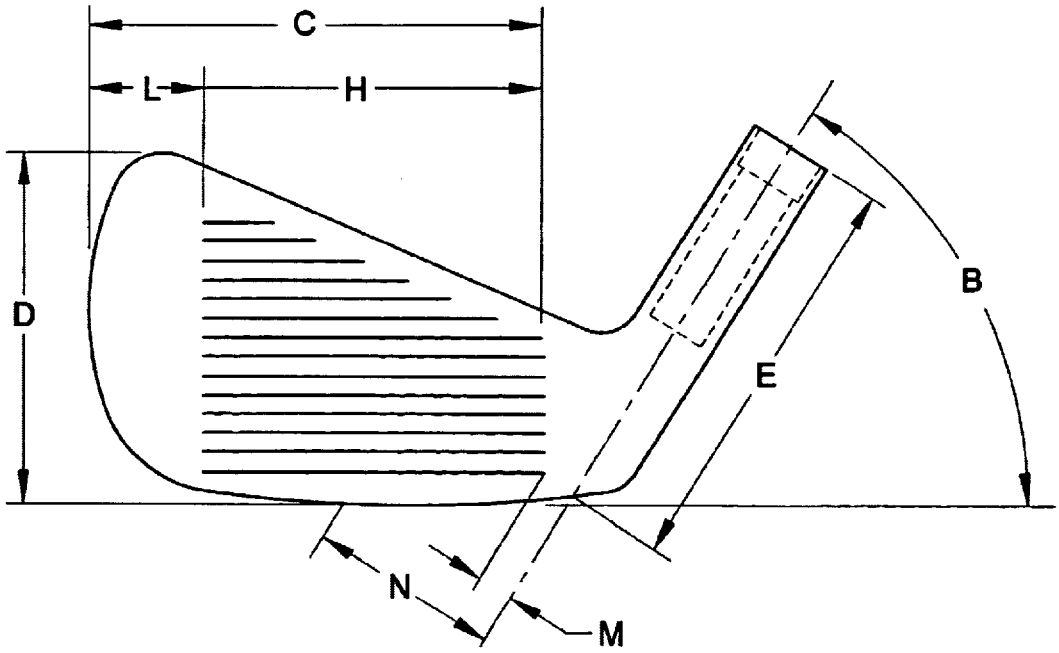
FIG. 4 is a front view of an iron club head in accordance with the present invention.

As shown in FIG. 3 (side view), the cantilevered mass 40 is spaced apart from the rear surface 34 of the club head. It is to be appreciated that spacing the cantilevered mass 40 apart from the rear surface 34 provides forgiveness for off-center hits. In other words, golfers may still produce acceptable shots despite striking the ball in a location on the striking face 30 other than the center or sweet spot 32. The cantilevered mass 40 tapers from a thickness that is greatest at the sole portion 24 toward the top ridge portion 26.

Figure 5A:
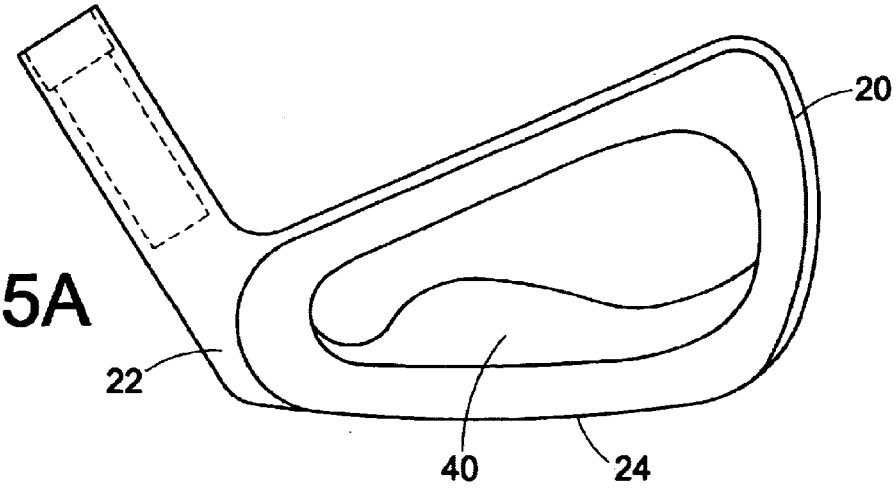
FIG. 5A is a back view of an exemplary long iron club head illustrating the cantilevered mass in a first position adjacent the heel in accordance with the present invention.
Figure 5B:
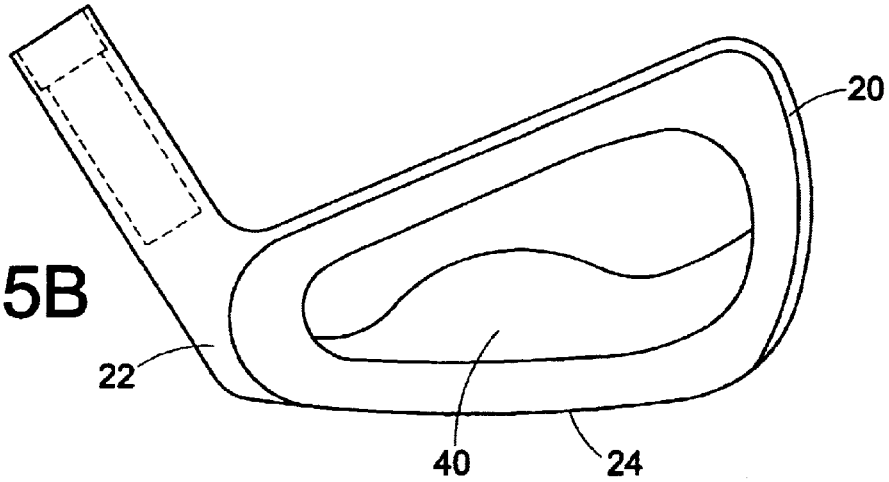
FIG. 5B is a back view of an exemplary middle iron club head illustrating the cantilevered mass in a second middle position in accordance with the present invention.
Figure 5C:
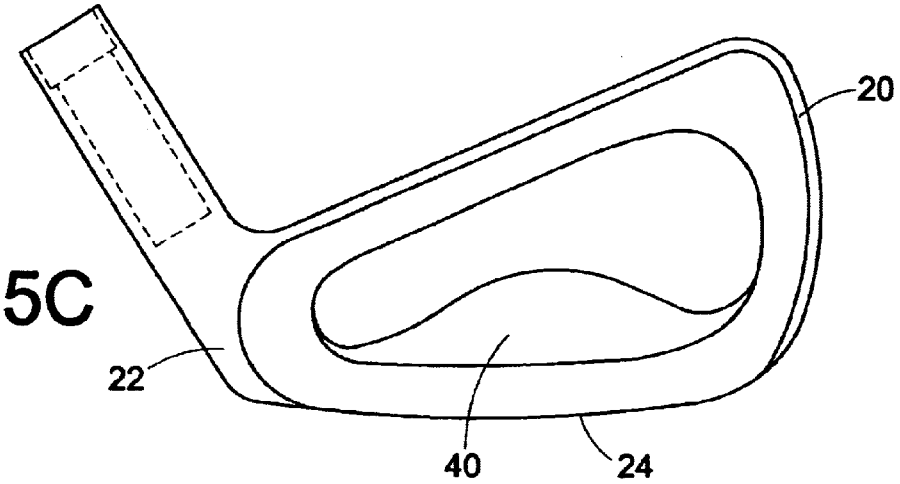
FIG. 5C is a back view of an exemplary short iron club head illustrating the cantilevered mass in a third position adjacent the toe in accordance with the present invention.

With reference to FIGS. 5A, 5B, and 5C, for an iron set consisting of 2, 3, 4, 5, 6, 7, 8, 9, PW, and SW, the cantilevered mass 40 is disposed in one of three positions along the bottom sole portion 24 between the heel portion 22 and the toe portion 20. The cantilevered mass is progressively moved from the low heel area (FIG. 5A) on long irons (2–4), to a middle position (FIG. 5B) on the middle irons (5–7), to a higher position toward the toe (FIG. 5C) on the short irons (8-SW). It is to be appreciated that varying the position of the cantilevered mass 40 varies the center of gravity for the club, and therefore, provides for optimum trajectory and launch angle for each golf shot. In one preferred embodiment, the cantilevered mass 40 is located approximately 1.00 inches from the heel portion in the long irons (FIG. 5A), approximately 1.187 inches from the heel portion in the middle irons (FIG. 5B), and approximately 1.375 inches from the heel portion in the short irons (FIG. 5C).

In a preferred embodiment, each iron club head 16 is comprised of a cryogenically treated steel. Artisans will appreciate that cryogenic treatment of metals, including steel, results in greater hardness and tensile strength than untreated metals. For example, cryogenic treatment of standard 17-4 pH steel results in a steel which is harder and stronger than both 6-4 titanium and alpha maraging steel. Because of the increased hardness and strength of cryogenically treated steel, the striking face thickness FT of the club head is thinner than conventional irons. In one embodiment, the striking face thickness FT is reduced from 0.145 inches to 0.130 inches. This reduction in face thickness FT results in a reduction of approximately 15 grams in striking face mass. This additional mass that is not present in the striking face is relocated other regions of the club head in order to enhance overall performance. Preferably, this additional mass is located in the peripheral mass and the cantilevered mass, resulting in a lower center of gravity and enhanced performance.

During the cryogenic treatment process, the temperature of the golf club head is slowly and gradually lowered to approximately −300 degrees Fahrenheit in a nitrogen gas-filled chamber. As the steel is supercooled, molecular movement is decreased and the molecules join together more tightly. As the temperature is gradually increased, the molecules remain closer together in a more uniform and dense formation, resulting in a stronger and harder substance. It is to be appreciated that a cryogenically treated steel golf club head produces greater energy transfer which translates into added distance in golf shots.

In a preferred embodiment, the following reduced face thicknesses FT in the primary striking zone or sweet spot 32 are present:

2–5 iron: 0.125–0.135 inches,

16–7 iron: 0.120–0.125 inches, and

8-PW: 0.115–0.120 inches.

For a preferred set of irons made in accordance with the present invention, the following dimensions are provided:

TABLE A-1

| Club | Loft Angle (A) (deg) | Lie Angle (B) (deg) | Bounce Angle (C) (deg) | Offset (D) (in.) | Hosel Length (E) (in.) | Face Length (G) (in.) | Score-line Length (H) (in.) |
|---|---|---|---|---|---|---|---|
| 1 | 16 | 57.5 | 0 | .230 | 2.450 | 2.925 | 2.325 |
| 2 | 18 | 58.5 | 0 | .220 | 2.450 | 2.925 | 2.325 |
| 3 | 21 | 59.5 | +1 | .220 | 2.450 | 2.925 | 2.325 |
| 4 | 24 | 60.5 | +2 | .205 | 2.450 | 2.925 | 2.325 |
| 5 | 27 | 61 | +2 | .190 | 2.450 | 2.925 | 2.325 |
| 6 | 31 | 61.5 | +3 | .175 | 2.450 | 2.925 | 2.325 |
| 7 | 35 | 62 | +3 | .160 | 2.450 | 2.925 | 2.325 |
| 8 | 39 | 62.5 | +3 | .145 | 2.450 | 2.850 | 2.250 |
| 9 | 43 | 63 | +4 | .130 | 2.450 | 2.850 | 2.250 |
| PW | 47 | 63.5 | +6 | .115 | 2.450 | 2.850 | 2.250 |
| SW | 55 | 64 | +10 | .100 | 2.450 | 2.850 | 2.250 |

TABLE B-1

| Club | Sole Width Heel (I) (in.) | Sole Width Center (J) (in.) | Sole Width Toe (K) (in.) | Ref. Dimension (L) (in.) | Hosel to Heel (M) (in.) | Hosel to Center (N) (in.) | Face Height (O) (in.) | Finish Weight (grams) |
|---|---|---|---|---|---|---|---|---|
| 1 | .600 | .800 | .700 | .600 | .135 | 1.057 | 2.045 | 232 |
| 2 | .600 | .800 | .700 | .600 | .145 | 1.074 | 2.075 | 239 |
| 3 | .600 | .800 | .700 | .600 | .155 | 1.096 | 2.105 | 245 |
| 4 | .600 | .800 | .700 | .600 | .165 | 1.118 | 2.135 | 251 |
| 5 | .600 | .800 | .700 | .600 | .175 | 1.134 | 2.165 | 257 |
| 6 | .600 | .800 | .700 | .600 | .185 | 1.149 | 2.195 | 264 |
| 7 | .600 | .800 | .700 | .600 | .195 | 1.165 | 2.225 | 271 |
| 8 | .600 | .800 | .700 | .600 | .205 | 1.172 | 2.235 | 278 |
| 9 | .600 | .800 | .700 | .600 | .215 | 1.187 | 2.273 | 285 |
| PW | .600 | .800 | .700 | .600 | .225 | 1.208 | 2.294 | 293 |
| SW | .600 | .800 | .700 | .600 | .235 | 1.223 | 2.400 | 306 |

Figure 6:
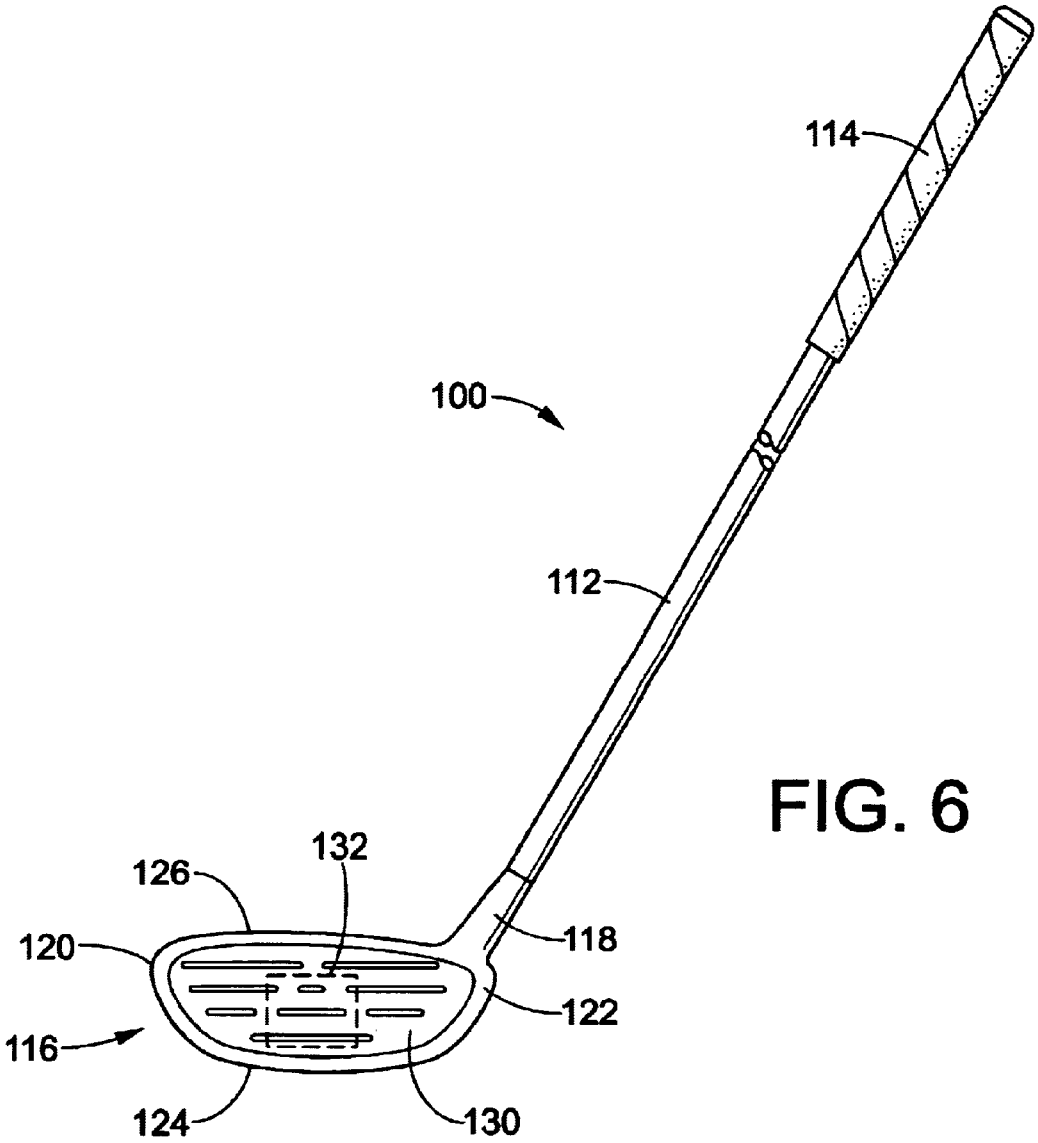
FIG. 6 is a front view of a metal wood in accordance with the present invention.
Figure 7:
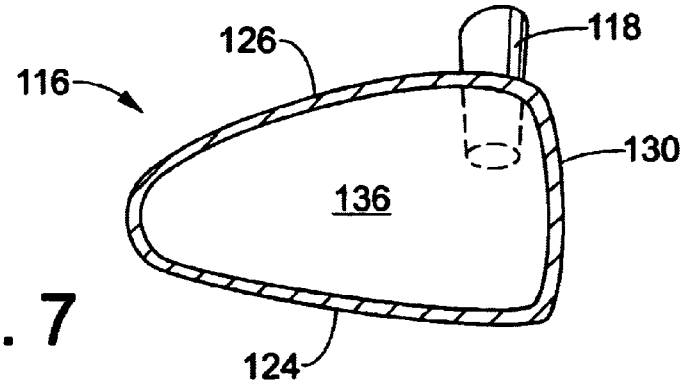
FIG. 7 is a side cross-sectional view of a metal wood club head in accordance with the present invention.

With reference to FIG. 6 and FIG. 7, a wood type golf club 100 comprises a shaft 112 with a grip 114 and a head 116. The head 116 is connected by a hosel 118 to the shaft 112 in a conventional manner. Similarly, the grip 114 is attached to the shaft 112 in a conventional manner. The head comprises a hollow body 136 having an inner cavity delimited by a sole portion 124. Additionally, the head 116 includes a toe portion 120, heel portion 122, and a crown portion 126. The front striking face 130, which contains a primary striking zone or sweet spot 132, is suitably scored with grooves.

Figure 8:
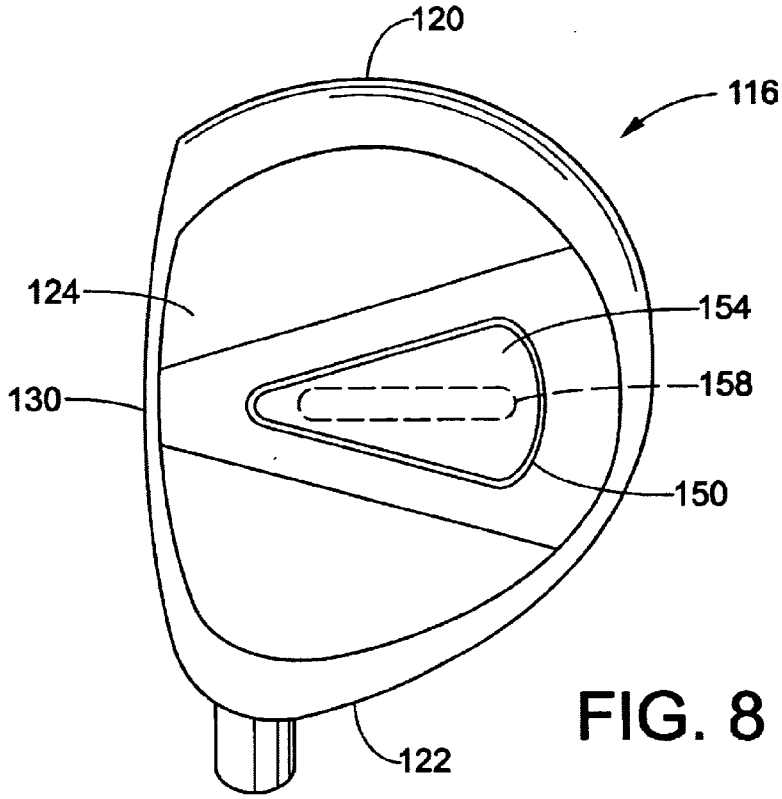
FIG. 8 is a sole view of the metal wood club head in accordance with the present invention.
Figure 8A:
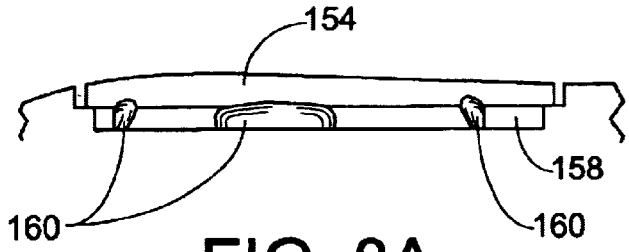
FIG. 8A is a perspective view of the weight chip which is welded to the metal wood club head in accordance with the present invention; and, FIG. 9 is a front view of the metal wood club head in accordance with the present invention.

FIG. 8 illustrates a sole view of the club head 116. The sole portion 124 of the club head contains a pocket 150 in which a weight chip 154 is disposed. In a preferred embodiment, the weight chip 154 is welded to the sole portion 124 inside the pocket 150 by a plurality of welds 160 disposed in a weld groove 158, as shown in FIG. 8A. While other means of fastening the weight chip to the sole portion, such as adhesives, fasteners and pressing, are contemplated, it is to be appreciated that welding provides a stronger and more permanent bond between the club head 116 and the weight chip.

In a preferred embodiment, the club head 116 is comprised of a cryogenically treated steel. As set forth above, it is to be appreciated that cryogenically treated steel provides greater hardness and tensile strength than conventional club head materials. Because of the increased hardness and strength of cryogenically treated steel, the striking face thickness of the club head is thinner than conventional metal woods. In a preferred embodiment, the primary striking zone or sweet spot of the striking face is between 0.130 and 0.135 inches. The reduction is striking face thickness results in a reduction of the mass of the striking face. In one embodiment, the additional mass not used in the thinner club face, is distributed around the sole portion and crown portion of the club head in order to enhance overall weighting and performance. In another embodiment, the additional mass is not distributed about the club head, resulting in a club having reduced mass.

Figure 9:
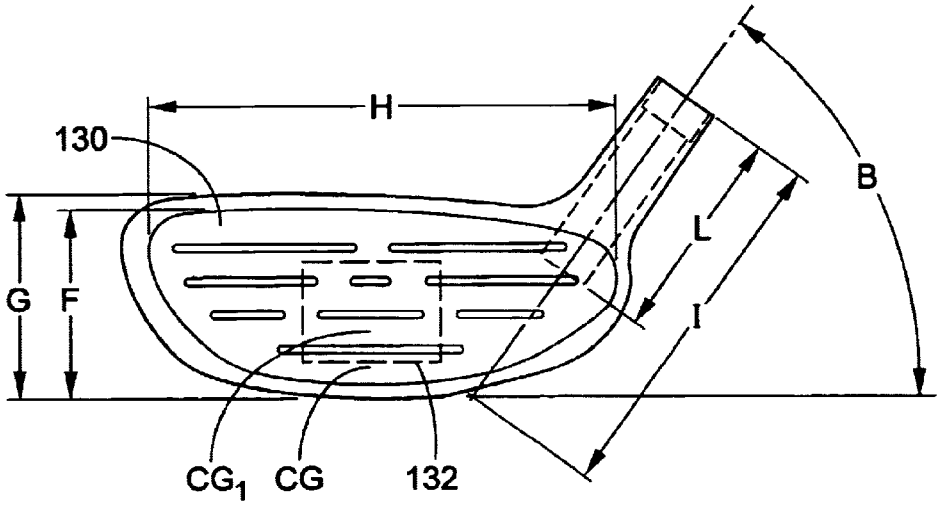

In a preferred embodiment, the weight chip is made out of tungsten having a mass of between 25 and 45 grams, preferably, 35 grams. Alternately, the weight chip is made of another metal which has a density greater than the density of the cryogenic steel of the club body. As shown in FIG. 9, the presence of the tungsten weight chip in the sole portion of the club head lowers the overall center of gravity CG of the club head versus a conventional center of gravity $CG_1$. It is to be appreciated that the lower center of gravity promotes more consistent distance and accuracy from off-center hits as well as a higher trajectory. Artisans will appreciate that the lower center of gravity promotes solid contact with balls which are in undesirable locations, such as long grass, dirt, and tight lies, i.e. where little or no grass is present under the ball. For a preferred set of woods made in accordance with the present invention, the following dimensions are provided:

TABLE A-2

| Club | Loft Angle (A) (deg) | Lie Angle (B) (deg) | Face Angle (C) (deg) | Face Roll Radius (D) (in.) | Face Bulge Radius (E) (in.) | Face Height (F) (in.) | Crown Height (G) (in.) |
|---|---|---|---|---|---|---|---|
| 1 | 9 | 55.5 | +2 open | 12 | 12 | 1.700 | 1.850 |
| 3 | 14 | 57 | 0 | 12 | 14 | 1.250 | 1.350 |
| 5 | 18 | 58 | 0 | 12 | 14 | 1.200 | 1.300 |

TABLE B-2

| Club | Face Length (H) (in.) | Hosel Length (I) (in.) | Hosel Diameter (J) (in.) | Hosel Bore Diameter (K) (in.) | Hosel Bore Depth (L) (in.) | Sole Radius (M) (in.) | Breadth (N) (in.) | Finish Weight (grams) |
|---|---|---|---|---|---|---|---|---|
| 1 | 3.500 | 2.500 | .500 | .339 | 1.375 | P.M. | 3.075 | 205 |
| 3 | 3.200 | 2.150 | .500 | .339 | 1.375 | P.M. | 3.050 | 209 |
| 5 | 3.100 | 2.100 | .500 | .339 | 1.375 | P.M. | 2.950 | 214 |

The invention has been described with reference to the preferred embodiment. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A method of making a metal wood golf club head comprising:

forming a club head having a striking face, a top portion, a bottom portion, a toe portion, and a heel portion, the striking face having a primary striking zone having at least a portion having a thickness between 0.115 inches and 0.135 inches, resulting in a reduced striking zone mass;

cryogenically treating the formed club head; and, distributing mass not used in the reduced striking zone mass about at least one of the striking face, the top portion, the bottom portion, the toe portion, and the heel portion.

2. The method according to claim 1, wherein the distributing mass step includes:

welding a weight chip into a weight insert pocket on the bottom portion of the club head, wherein the weight chip is made of a higher density material than the cryogenically treated steel.

3. The method according to claim 1, wherein the cryogenically treating step includes:

controllably cooling the formed club head to approximately −300 degrees Fahrenheit.

4. The method according to claim 3, further comprising:

welding a weight chip into a weight insert pocket within the sole portion, wherein the weight chip is made of tungsten.

5. A method of making a metal wood golf club head comprising:

forming a club head having a striking face, a top portion, a bottom portion, a toe portion, and a heel portion, the striking face having a primary striking zone having at least a portion having a thickness between 0.115 inches and 0.135 inches, resulting in a reduced striking zone mass;

cryogenically treating the formed club head; and, distributing mass not used in the reduced striking zone mass about the bottom portion by welding a tungsten weight chip into a weight insert pocket on the bottom portion of the club head, said tungsten weight chip having a mass between 25 grams and 45 grams.

* * * * *